United States Patent [19]

Ray et al.

[11] 3,990,193

[45] Nov. 9, 1976

[54] PREFABRICATED BUILDING MODULE AND MODULAR CONSTRUCTION METHOD FOR THE MODULE

[76] Inventors: Orlando F. Ray, 1472 Calve St. Antosanti, Rio Biedras, P.R. 00927; Enrique H. Gutierrez, P. O. Box 13171, Santurce, P.R. 00908

[22] Filed: Mar. 25, 1974

[21] Appl. No.: 454,702

Related U.S. Application Data

[62] Division of Ser. No. 245,090, April 18, 1972, abandoned.

[52] U.S. Cl. ..... 52/79; 52/745

[51] Int. Cl.[2] ..... E04B 1/34

[58] Field of Search ..... 52/79, 340, 383, 431, 52/250, 251, 258, 600, 602, 745

[56] References Cited

UNITED STATES PATENTS

| | | | |
|---|---|---|---|
| 1,640,065 | 8/1927 | Blaw | 52/303 |
| 2,053,873 | 9/1936 | Niederhofer | 52/250 |
| 2,108,065 | 2/1938 | Kotrbaty | 52/262 |
| 2,145,496 | 1/1939 | Reinhard | 52/91 |
| 2,703,003 | 3/1955 | Ruppel | 52/602 |
| 3,331,170 | 7/1967 | Lowe | 52/79 |
| 3,468,081 | 9/1969 | Saarinen | 52/79 |
| 3,514,910 | 6/1970 | Comm | 52/79 |
| 3,564,795 | 2/1971 | Henton | 52/79 |
| 3,763,613 | 10/1973 | Wise | 52/723 |

FOREIGN PATENTS OR APPLICATIONS

| | | | |
|---|---|---|---|
| 263,300 | 7/1968 | Austria | 52/422 |
| 2,014,558 | 10/1970 | Germany | 52/340 |

*Primary Examiner*—John E. Murtagh
*Attorney, Agent, or Firm*—Kenyon & Kenyon, Reilly Carr & Chapin

[57] ABSTRACT

A prefabricated building module comprising at least two side-walls, a ceiling, and a floor. In one embodiment of the building module, the walls, ceiling and floor each include a thin, continuous layer of a concrete-like material having spaced-apart, open web bar girders embedded in one surface thereof. The two side-walls, the ceiling and the floor are assembled together with the bar girders extending outwardly and are rigidly attached to one another, for example, by welding the ends of the bar girders to one another, thus forming a rigid, box-like building module. The building modules can be formed into a building by placing one layer of building modules with one side-wall of each module adjacent to but spaced-apart from one side-wall of a different module. Concrete is poured into at least a portion of the space between the side-walls of adjacent building modules for forming a supporting column between the adjacent side-walls which is reinforced by the bar girders which extend outwardly from the side-walls and into the space. The supporting column and the building modules on either side thereof are thus rigidly joined to one another by the bar girders. If a multistory building is required, a shoulder or saddle is formed on top of the supporting column for supporting a portion of the adjacent modules to be placed directly above the modules on each side of the supporting column until concrete can be poured therebetween.

11 Claims, 19 Drawing Figures

5
17
88
10
10
9
9
3
2
6
6
40
41
7
7
40
8
8
9
6
54
54
90
6
4
4
1
1
1
73
72
65
66
73
72
65
66

Fig. 11.
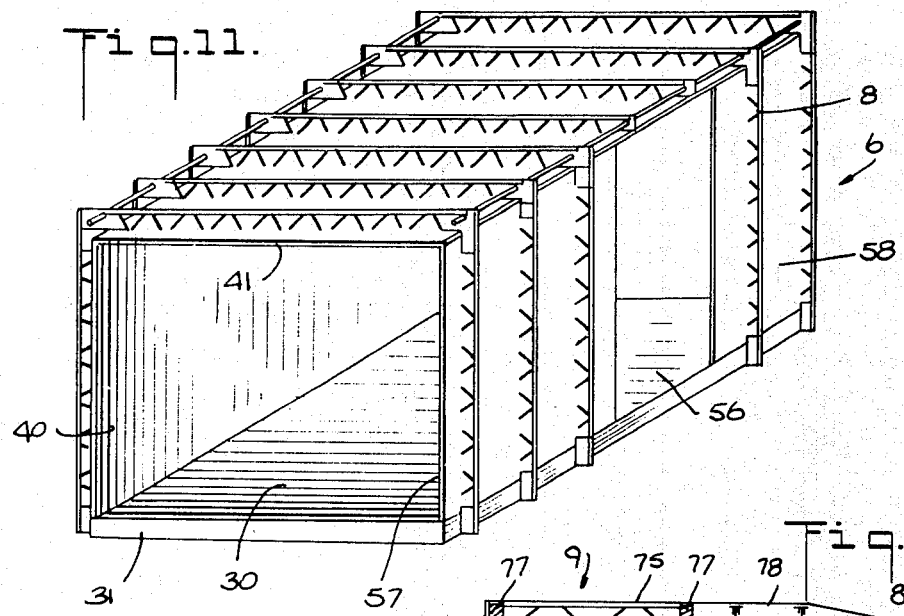
Fig. 13.
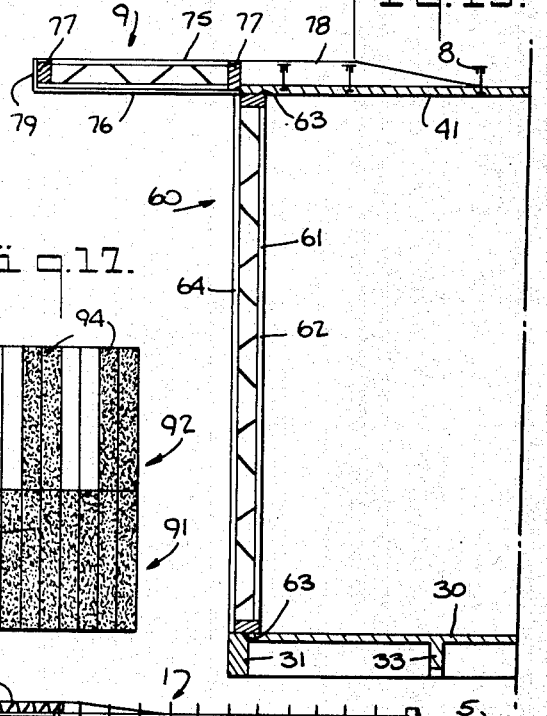
Fig. 10.
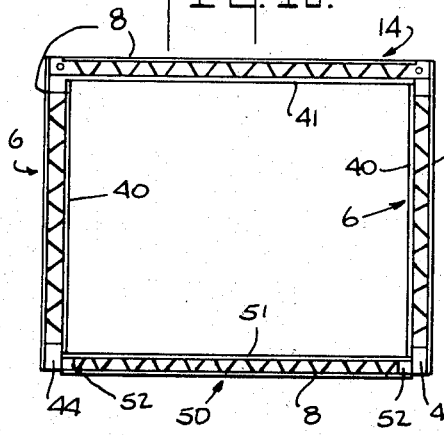
Fig. 17.
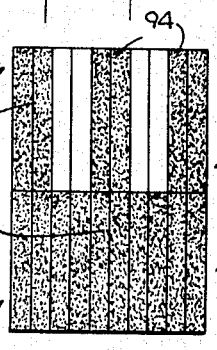
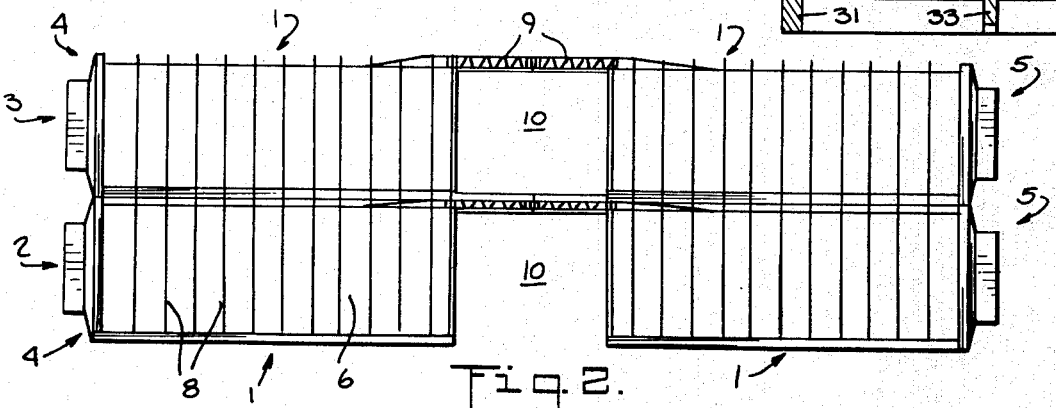
Fig. 2.

Fig 14.
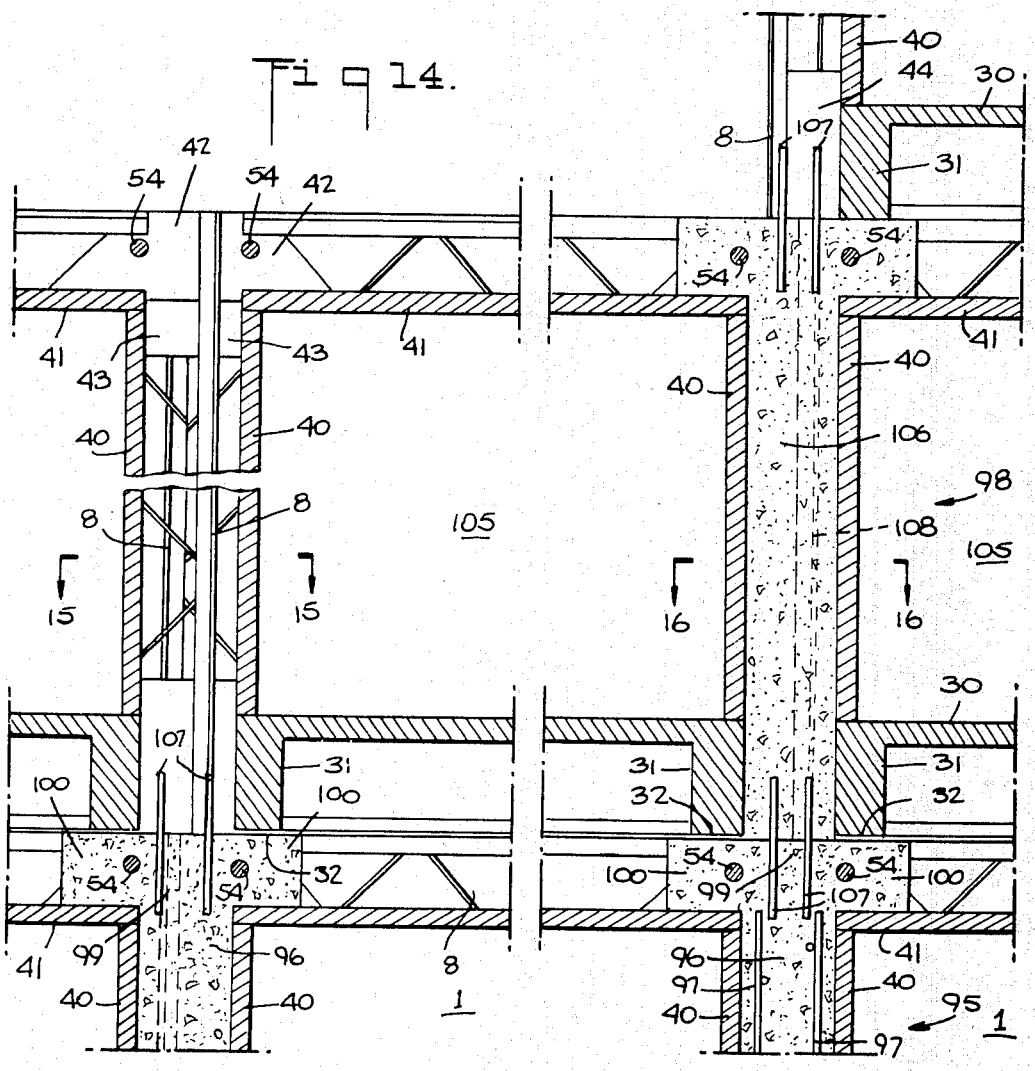
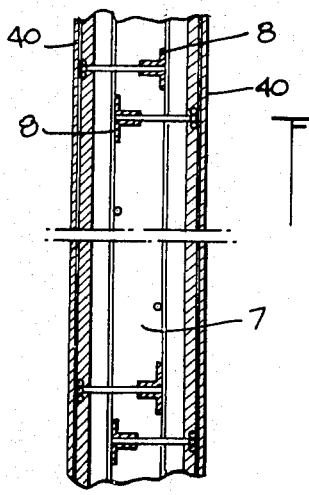
Fig.15.
Fig.16.
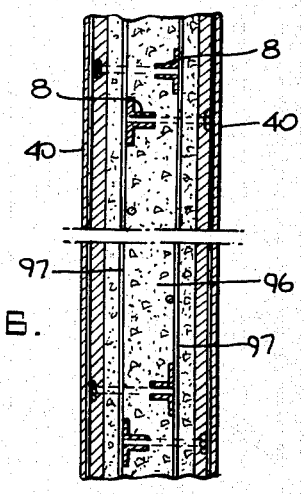

112
111
1
3
113
110
5
4
114
2
1

PREFABRICATED BUILDING MODULE AND MODULAR CONSTRUCTION METHOD FOR THE MODULE

This is a division of application Ser. No. 245,090 filed Apr. 18, 1972, now abandoned.

BACKGROUND OF THE INVENTION

The present invention relates to a prefabricated building module, a method for constructing a building from the prefabricated building modules and the building formed therefrom.

Modular construction of buildings has been used for many years as one means for reducing construction time and expense. Modular construction has the advantages that the modules can be prefabricated at some remote place such as a factory and subsequently transported to the building site where the modules can be assembled into a building. Thus, the advantages afforded by modular construction are more fully realized when the module is relatively easy to construct thereby reducing the expense of prefabricating the module. The advantages are further realized when the weight of the module is reduced as much as possible so that the module can be easily handled and transported to the construction site. However, the structural integrity of the module cannot be imparied in order to reduce the weight of the module, and a compromise is necessary to provide a lightweight module which also has sufficient strength and rigidity that will permimt it to be handled and transported without damage to the module. The weight and structural integrity of the module are also important when modules are assembled at the construction site. For example, in a tall building, the modules forming the upper story of the building would have to be hoisted several hundred feet before they can be placed into position on the top of the building.

Another advantage of modular construction of buildings is that it affords an opportunity for the concrete superstructure of the building to be formed around the modules, thus eliminating the need for concrete forms to be assembled and removed as the building progresses. Known building modules have been designed which attempt to incorporate each of the above advantages afforded by modular construction. For example, two such known modules are described in U.S. Pat. No. 3,331,170, issued July 18, 1967, and U.S. Pat. No. 3,514,910, issued June 2, 1970.

Although generally satisfactory, known modules do not take sufficient advantage of the opportunities afforded by modular construction. By way of example, known concrete modules are not relatively easy to prefabricate and they are not sufficiently lightweight, but yet rigid to keep the manufacturing and transportation costs competitive with other forms of building construction. Further, since the weight of a typical concrete module having a floor space of about 270 square feet would exceed 10 tons, heavy duty hoisting equipment such as a crawling crane must be used to assemble the modules at the construction site. Therefore, the heavy duty hoisting equipment must generally remain at the construction site until the modules for the upper story of the building have been positioned, which could easily require many months. The expense of having such heavy equipment at the construction site significantly increases the total construction cost of the building. Finally, the total height of a building constructed with known modules would be limited by the boom length of available crawling cranes which is typically less than 220 feet.

SUMMARY OF THE INVENTION

The present invention provides a prefabricated building module and a modular construction method which avoids or obviates many of the disadvantages of known modular construction techniques. Thus, the prefabricated building module of the present invenion is relatively simple to manufacture, has a significantly reduced weight for a given habitable volume enclosed therein and is sufficiently lightweight but yet adequately rigid to permit the modules to be readily transported from the place of manufacture to the construction site and to be readily positioned at the construction site by inexpensive hoisting equipment such as a climbing crane.

One embodiment of the prefabricated building module comprise at least two side-walls and the ceiling each including a thin, preferably continuous layer or panel of concrete-like material. The layers or panels of a concrete-like material are reinforced by a plurality of spaced-apart metal reinforcing members having a portion thereof embedded in one surface of the panel. The remainder of each reinforcing member extends outwardly from the one surface of the panel and is adapted to be embedded in a concrete colume or wall to be formed between adjacent building modules. Each reinforcing member preferably extends completely across the one surface of the panel.

As will be explained more fully hereinafter, the metal reinforcing members serve at least three primary functions. The reinforcing members reinforce the thin panels of a concrete-like material so that they will not buckle while they are being assembled to form a module and, in the case of the panels forming the side-walls, so that they will not buckle when a concrete-like material is being poured between the spaced-apart side-walls of adjacent building modules in the building to be constructed to form a weight supporting column therebetween. The reinforcing members can also be used to rigidly attach the respective panels forming the ceiling, the two side-walls and the floor to one another so that the building module will be capable of withstanding the loads imposed thereon during transportation of the module and while it is being placed into position in the building to be constructed. Further, the reinforcing members serve as reinforcing for the weight supporting columns or walls to be formed between adjacent modules and rigidly connect or integrate the adjacent modules with the column or wall so formed.

Although the metal reinforcing members can take many forms, one preferred member is an open web girder having two spaced-apart flanges connected to one another along the length of the flanges by an open web. The flanges provide additional lateral strength for the reinforcing members and enable a portion of each member, that is, one of the flanges, to be firmly embedded in the thin panels of a concrete-like material. The open web generally reduces the weight of the reinforcing member, thus reducing the total weight of each building module, while providing sufficient strength for each member. By way of example, one type of open web girder is an open web bar girder wherein the two spaced-apart flanges are connected to one another by a rod or bar having alternaate bends therein. The bar is alternately connected to the one of the flanges at each of the alternate bends in the bar.

The term "concrete-like material" as used herein is intended to include, and has reference to, any flowable, hardenable material such as concrete or other cementituous materials which can be formed or poured while it is in a flowable state and which subsequently hardens to form the required structure. The concrete-like material used to form the thin, continuous layers or panels of the side-walls and ceiling, as well as other portions of the building modules, are preferably constructed from a lightweight concrete to reduce the weight of the modules. The weight support columns or walls of the building to be formed from the building modules can be constructed from a conventional concrete used in the building trade.

The floor of the building module can be constructed in one of several ways, for example, the floor can be formed in the same manner as the two side-walls and the ceiling, that is, from a thin, continuous layer or panel of a concrete-like material having spaced-apart reinforcing members such as open web girders embedded in one surface thereof. If low noise transmission between building modules placed one above the other is desired, it is preferable for the floor to include a thin, continuous layer or panel of a concrete-like material havivng spaced-apart rib members extending outwardly from one surface of the thin panel. The spaced-apart rib members are preferably constructed from a concrete-like material which is integrally cast with the thin panel of a concrete-like materil. It is also possible for a conventional slab of a concrete-like material having uniform thickness to be used as the floor of the building module, but such construction is generally not as lightweight as the ribbed panel of concrete-like material described above.

The building module is prefabricated from the two side-wall panels, the ceiling panel and the floor panel by assembling them with respect to one another in the conventional manner. Thus, the two side-wall panels are spaced-apart from and approximately parallel to one another with the other surface of one panel facing the other surface of the other panel. The floor panel extends across the opening defined by the lower ends of the opposing side-wall panels, and the ceiling panel extends across the opening defined by the upper ends of the opposing side-wall panels. The rib members and/or open web girders project outwardly from the habitable volume enclosed by the respective panels forming the building module. The open web girders of the opposing side-walls preferably extend vertically like studs, and the open web girders of the ceiling preferably extend horizontally like joists between the corners formed by the ceiling panel and the two opposing side-wall panels.

As noted above, it is desirable that the thin panels of a concrete-like material forming the two side-walls, the ceiling and the floor of the building module be rigidly connected to one another for forming a rigid, box-like structure having an opening at two opposing ends thereof. One preferred means for rigidly connecting the ceiling panel to the two opposing side-wall panels is to rigidly attach, for example, by welding, the upper end of a plurality of the open web girders of the opposing side-wall panels to the respective ends of the open web girders of the ceiling panel. When the floor panel includes a thin, continuous layer or panel of a concrete-like material having rib members integrally cast therewith, it is preferable to rigidly attach the floor panel to the two opposing side-wall panels by rigidly attaching, for example, by welding, the lower end of the open web girders of the side-wall panels to metal anchor plates embedded in the perimeter of the floor panel. When the floor panel is constructed from a thin, continuous layer or panel of a concrete-like material having open web girders embedded therein, it is preferable to rigidly attach the floor panel to the two opposing side-wall panels by rigidly attaching, for example by welding, the lower end of the open web girders of the two opposing side-wall panels to the respective ends of the open web girders of the floor panel.

The thickness of the thin, continuous layers or panels of a concrete-like material used to construct the building module of the present invention will depend upon structural analysis of the panels. The most important factors in determining the thickness are the size of the panel, the size of the open web girders embedded therein, and the spacing between them. By way of example, the thickness of the panels could typically vary between seven-eights of an inch to two inches. Similarly, the size and spacing of the open web girder must also be determined by structural analysis. As an example, the depth of the open web girders would typically be from about 3 inches to about 10 inches.

The total weight of the building module would be determined by the overall dimensions of the building module and as well as the other variables such as the thickness of the panels and the size and spacing of the open web girders. As noted above, one of the principle advantages of the building module is that it can be lifted into place by conventional light hoisting equipment such as a climbing crane which typically has a lifting capacity of around nine tons. By way of example, a prefabricated building module having interior dimensions measuring eight feet by eleven feet by twenty-four feet could be designed in accordance with the present invention to have a total weight of about nine tons. Thus, the two side-wall panels, the ceiling panel, and the floor panel would each be constructed from a 1θ inch thick layer of lightweight concrete having open web bar girders with a five inch depth embedded therein. As will be explained more fully hereinafter, such a building module would be completely finished, including end walls as well as the necessary partitioning, plumbing and electrical wiring, and be ready to be placed into position in the building.

The prefabricated building module of the present invention can be used to construct a single story building; however, the prefabricated building modules are particularly advantageous for constructing multi-story buildings. When a multi-story structure is to be built, the prefabricated building module for the first story floor are assembled by placing at least one side-wall panel of each building module adjacent and approximately parallel to one of the side-wall panels of a different building module. Adjacent building modules are spaced-apart to define a space between the one space of each of the adjacent side-wall panels of the building modules. As will be explained more fully hereinafter, the space is for pouring concrete between the adjacent side-wall panels which serve as concrete forms for constructing the main structural supporting column or wall of the building. The minimum width of the space between the one surface of the adjacent side-wall panels is determined by the depth of the open web girders extending from the adjacent side-wall panels into the space therebetween, and the depth will be at a minimum when the girders are completely nested with one another. However, if additional structural support is required from the supporting columns formed between the adjacent modules, the building modules can be placed adjacent one another with any desired space therebetween.

Once the adjacent building modules are in place, and any additional structural steel which is desired for the supporting column has been added, at least a portion of the space between the adjacent side-wall panels is filled with concrete-like material, thus forming a supporting column between the adjacent building modules. The open web girders embedded in the adjacent side-wall panels and the panels are stiff enough to resist the lateral pressure created by the concrete as it is being poured and while it is setting. When the concrete supporting column has subsequently set, the open web girders are embedded in the supporting column and serve as reinforcing for the column. Thus, after the concrete has set, the thin panels of a concrete-like material forming the two adjacent side-walls, as well as the open web girders extending from the side-walls, are integrated with the supporting column in such a way that each element cooperates to its fullest in developing structural strength for the building.

A cap or shoulder is formed on the top of the supporting column between the adjacent modules for supporting the next layer of building modules in place while concrete is poured therebetween. A portion of the shoulder preferably extends over each of the side-wall panels on either side of the column and along the length of the column. Thus, when a shoulder is formed on the top of a supporting column on each side of a module, another building module can be placed directly above the module with the floor panel thereof supported between the saddle formed by the extended portion of these two shoulders.

Accordingly, a second story or level of building modules can be assembled above the first level of building modules in the same manner as described above. Once adjacent modules are in place, additional concrete can be poured therebetween forming another supporting column on top of the supporting column between the adjacent modules directly below. Once the bearing walls between the adjacent building modules of the second layer have been formed, thus integrally connecting these modules to the supporting structure of the building, additional levels or stories of modules can be provided in a similar manner.

Since the prefabricated building modules of the present invention are relatively lightweight, they can be lifted or hoisted by a conventional crane such as a climbing crane which is typically supported from one or more of the uppermost stories of the building being constructed. Thus, the ultimate number of levels or stories of building modules to be used in forming the modular building structure is not limited as in known modular construction techniques wherein the weight of the building module typically exceeds the lifting capacity of conventional cranes and a heavy duty crane such as a crawling crane must be used. These heavy duty cranes typically have a maximum boom length of about 228 which thus limits the height of a building which can be constructed.

Accordingly, it is an object of the present invention to provide a prefabricated building module and a modular construction method for forming a building from the prefabricated building modules.

Another object of the present invention is to provide a prefabricated building module that is structurally rigid but yet relatively light in weight so that the building module can be easily transported and readily positioned for forming a building therefrom.

Still another object is to provide a prefabricated building module constructed of thin layers or panels of a concrete-like material having open web girders extending outwardly therefrom which provide structural integrity for the thin panels and provide a rigid, lightweight box-like construction for the building module.

A further object of the present invention is to provide such a prefabricated building module wherein the thin panels are adapted to serve as the forms for the concrete to be poured to form the supporting columns or walls of a building constructed of the modules and wherein the thin panels and the open web girders become an integral part of the columns of the structure.

BRIEF DESCRIPTION OF THE DRAWINGS

FIG. 2 is a side elevation view of the building of FIG. 1.

FIG. 6 is a cross-sectional view of the building module of FIG. 5.

FIG. 10 is a cross-sectional view of another embodiment of the building module.

FIG. 11 is a perspective view of the building module of FIG. 5 showing an opening constructed in one of the side-walls.

FIG. 13 is a cross-sectional view of one end of the building module of FIG. 12.

FIG. 14 is a cross-sectional view through the building module of FIG. 12.

FIG. 15 is a cross-sectional view of the space formed between two of the adjacent building modules of FIG. 14.

FIG. 16 is a cross-sectional view of the wall formed between two adjacent building modules of FIG. 14.

FIG. 17 is an elevation view of one wall which can be formed between adjacent building modules on two contiguous floors of a building.

FIG. 19 is a perspective view of another building being constructed from the prefabricated building modules of the present invention.

BRIEF DESCRIPTION OF THE INVENTION

Figure 1:
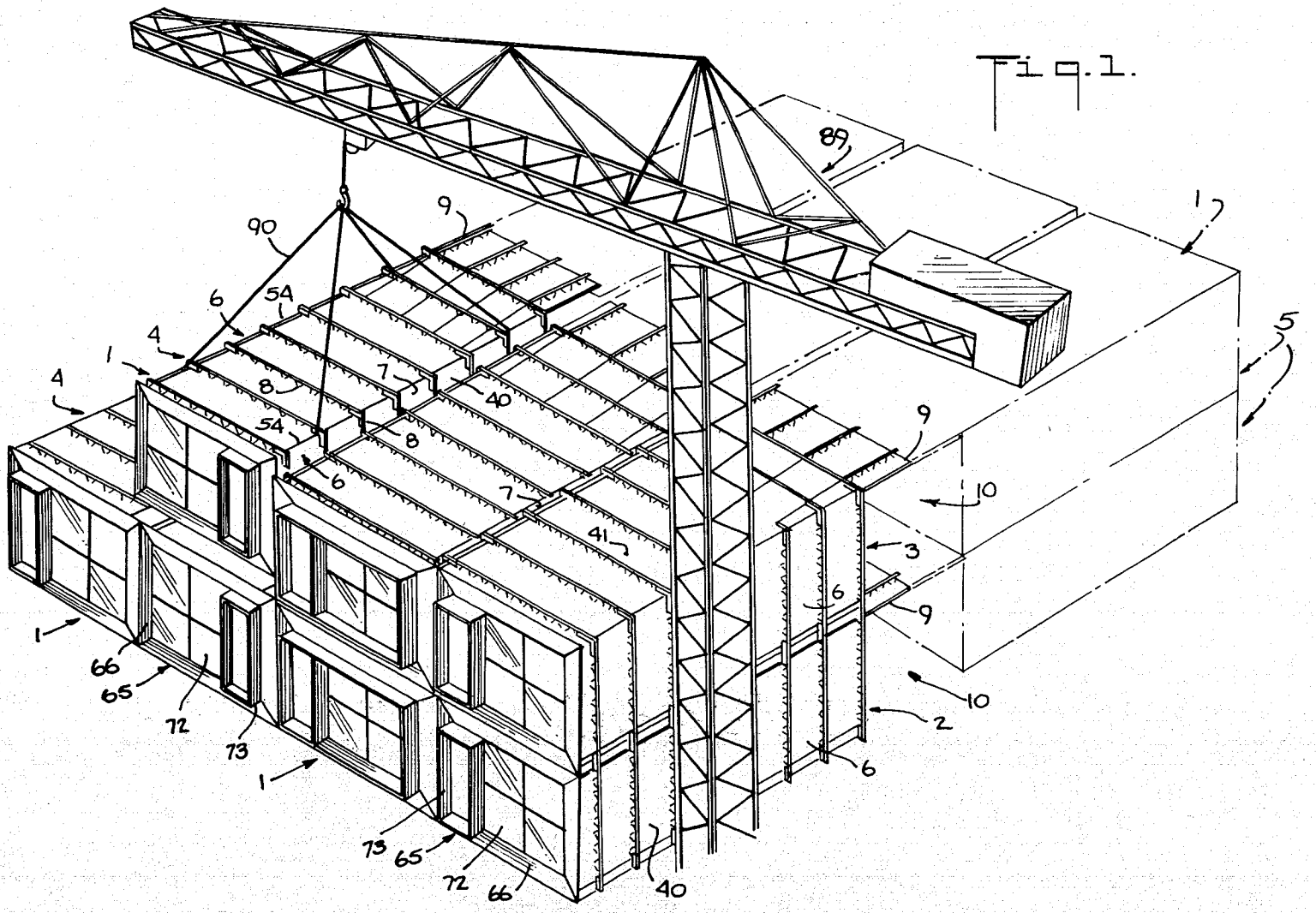
FIG. 1 is a prespective view of a building being constructed from the prefabricated building modules of the present invention.

A perspective view of a portion of a building being constructed from the prefabricated building modules 1 of the present invention is shown in FIG. 1, and a side-elevation view of the building is shown in FIG. 2. The building being constructed is a multi-story building having at least two floors or layers 2 and 3 of building modules wherein each floor includes two spaced-apart rows 4 and 5 of building modules. The building modules 1 in each row 4 or 5 are placed with at least one side-wall 6 of each building module 1 adjacent and approximately parallel to one of the side-walls 6 of a different building module 1. The adjacent building modules 1 are spaced-apart to define a space 7 between the adjacent side-walls 6 of the building modules with the open web girders 8 embedded therein extending into the space. Further, as will be explained more fully hereinafter a ledge or overhanging portion 9 can be provided which preferably extends from the top of each building module 1 into the space 10 between the opposing rows 4 and 5 of the building modules 1. The ledge 9 on opposing building modules preferably abut one another thus forming an enclosed volume between the opposing rows of building modules which can serve as a hallway or other means for access into the habitable volume enclosed within the building modules 1.

Figure 8:
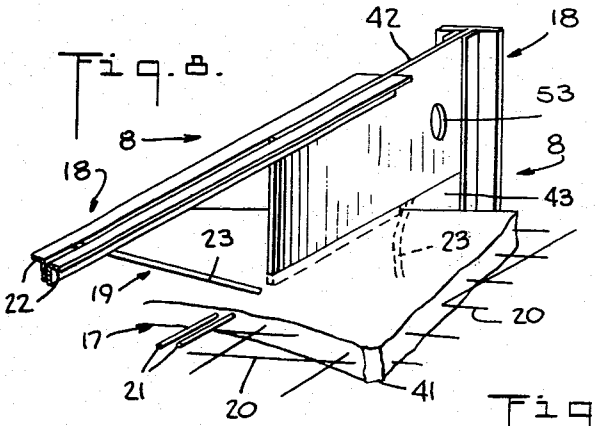
FIG. 8 is a perspective view of one of the upper corners of the building module showing one means for rigidly attaching the reinforcing members of the ceiling and one side-wall to one another.
Figure 7:
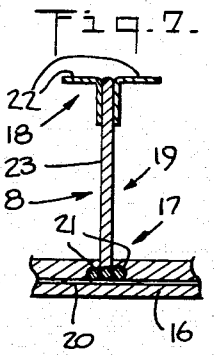
FIG. 7 is a cross-sectional view of the ceiling of the building module of FIG. 6 showing one type of reinforcing member for the ceiling.

Now referring to FIGS. 3–9, one embodiment of the building module 1 preferably comprises at least two side-walls 6, a ceiling 14 and a floor 15. The two side-walls 6 and the ceiling 14 each include a thin, continuous panel or layer 16 of a concrete-like material and a plurality of open web girders 8 which are spaced-apart from one another and have one flange 17 of each girder embedded in one surface of the panel 16 of a concrete-like material. The other flange 18 and the open web 19 of each of the open web girders 8 extends outwardly from the panel 16. The open web girders 8 embedded in the panels 16 reinforce and strengthen the panels, and as will be described more fully hereinafter, can be used to rigdly attach the ceiling panel to each of the two side-wall panels to form a habitable volume within the building module. Further, as shown in FIGS. 7 and 8 each thin, continuous panel 16 of a concrete-like material is preferably further reinforced with steel reinforcing such as a welded wire mesh 20.

Figure 9:
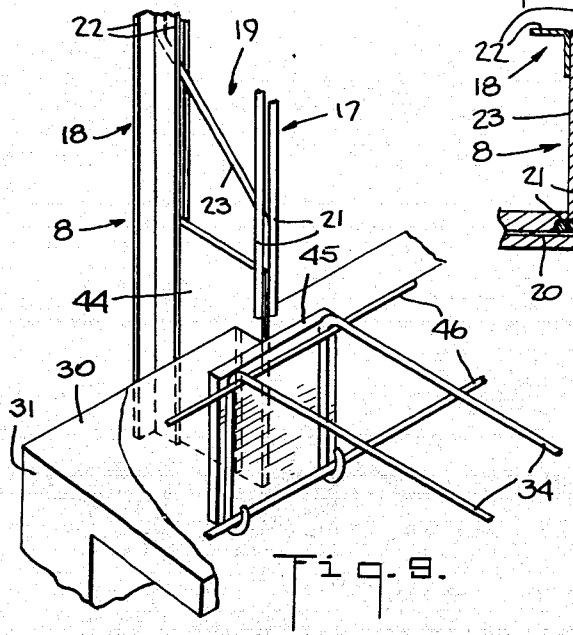
FIG. 9 is a perspective view of one of the lower corners of the building module showing one means for rigidly attaching the reinforcing members of one of the side-walls to the floor.

Referring particularly to FIGS. 7–9, one preferred open web girder is shown. The girder is one type of open web bar girder 8 having the one flange 17 formed from two spaced-apart rods 21 and the other flange 18 formed from two spaced-apart angle irons 22. The open web 19 is formed from a rod or bar 23 having alternate bends therein which extends between the respective flanges 17 and 18 along the length of the open web bar girder 8. The bar 23 is rigidly attached to the respective flanges at each of the bends in the bar, for example, by welding the bar 23 between the two rods 21 of the one flange 17 or between the angle irons 22 of the other flange 18. As shown in FIGS. 7–8, the one flange 17 of the open web bar girder 8 is embedded in the thin, continuous panel 16 of a concrete-like material with the other flange 18 and the bent rod 23 extending outwardly from, and preferably perpendicular to, the panel.

Figure 3:
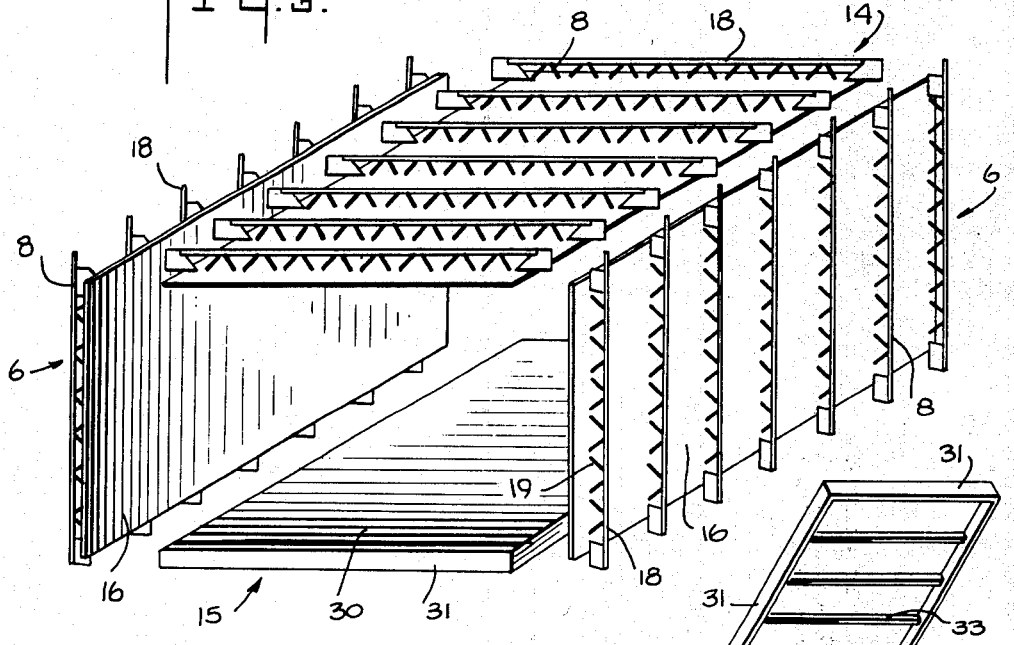
FIG. 3 is a perspective view of one embodiment of the building module showing the ceiling, floor and two opposing side-walls being placed with respect to one another.
Figure 4:
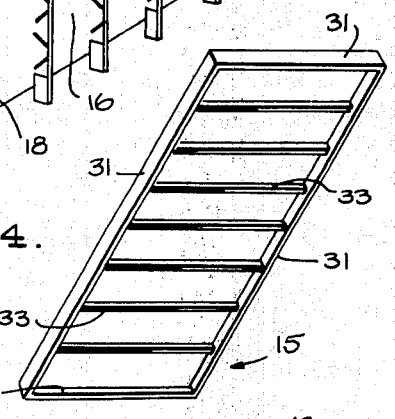
FIG. 4 is a perspective view of one embodiment of the floor of the building module.

As described above, the floor 15 of the building module 1 can be constructed in one of several different ways. The floor 15 in the embodiment of the building module as shown in FIGS. 3–4 is preferably used when low noise transmission between modules placed one above the other is desired. Thus, the floor 15 includes a thin, continuous layer or panel 30 of a concrete-like material having rib members extending downwardly from one surface thereof. For example, one rib member 31, preferably integrally cast with the floor panel 30, can be provided around the perimeter of the lower surface of the floor panel 30. It is preferable that the one rib member 31 have a rectangular cross-section, thus forming a flat bearing or load supporting surface 32 around the perimeter of the floor panel 30. Additional rib members 33, shown in FIGS. 4 and 6, can be provided which extend across the lower surface of the floor panel 30 between two of the opposing rib members 31. The additional rib members 33 are spaced-apart from one another in the manner of joists to strengthen the thin floor panel. The floor panel 30 can be further strengthened by providing reinforcing therein such as welded wire mesh (not shown) or the steel reinforcing rods 34 illustrated in FIGS. 6 and 9.

Figure 5:
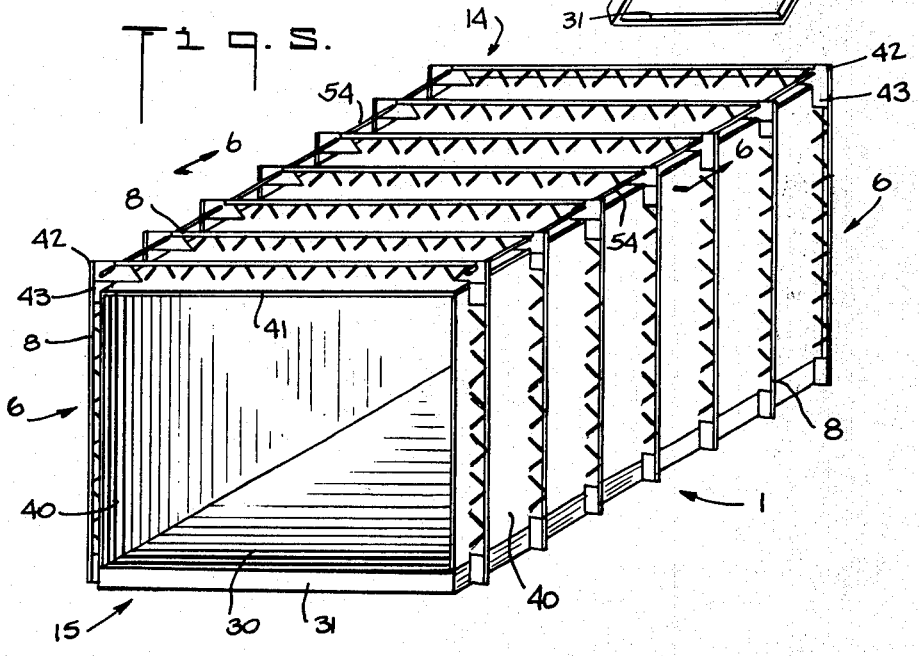
FIG. 5 is a perspective view of the embodiment of the building module of FIG. 3 showing the ceiling, floor, and two opposing side-walls being rigidly attached to one another.
Figure 5:
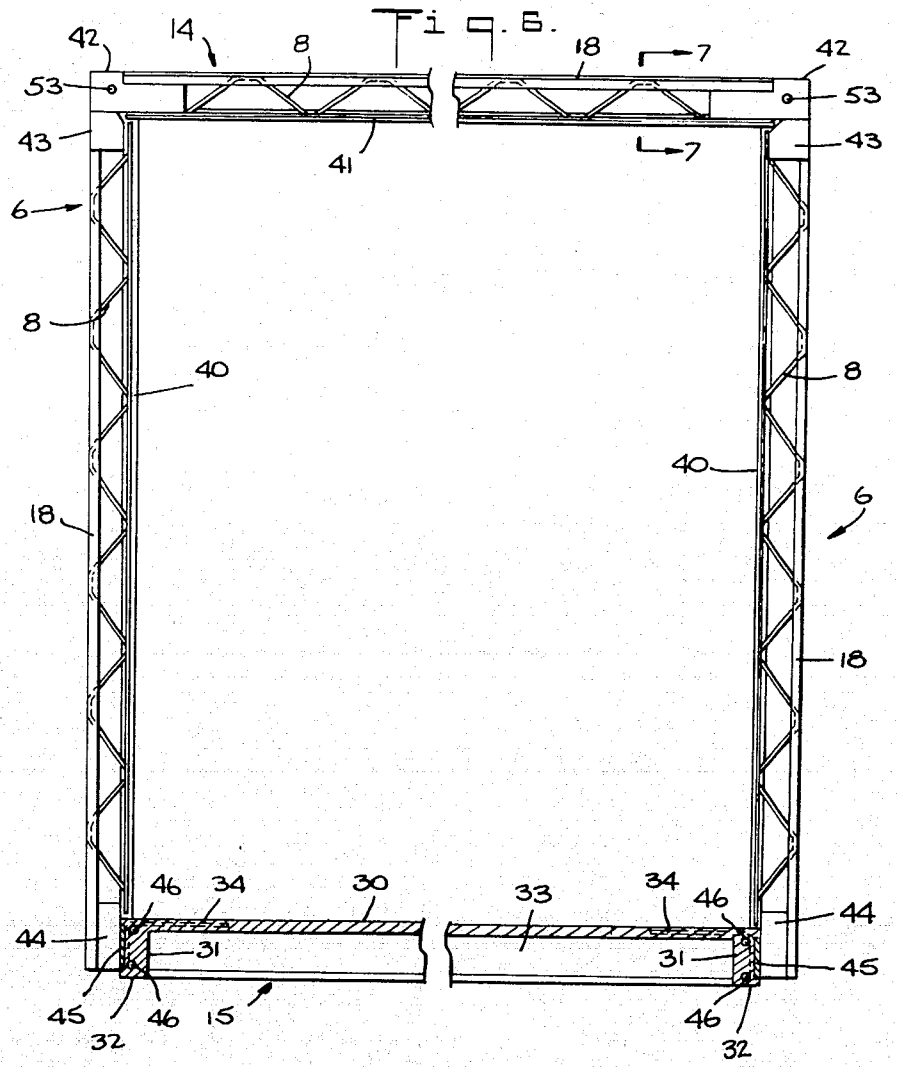

Referring particularly to FIGS. 5 and 6, the building module 1 is prefabricated by assembling the two side-wall panels 40, the ceiling panel 41 and the floor panel 30 to form the habitable volume in the interior of the building module. The two side-walll panels 40 preferably have the open web girders 8 embedded therein extending vertically in the manner if conventional studs, and the ceiling panel 41 preferably has the open web girders 8 embedded therein extending horizontally in the manner of conventional joists between the corners defined between the ceiling panel 41 and the two side-wall panels 40. Once the respective panels of a concrete-like material have been assembled as illustrated in FIG. 5, the panels are rigidly connected to one another, thus forming a rigid, box-like structure having an opening in two of the opposing ends thereof.

One preferred means for rigidly attaching the ceiling panel 41 to the two side-wall panels 40 is to rigidly connect the upper end of the open web girders 8 of the side-wall panels 40 to the respective ends of the open web girders 8 of the ceiling panel 41. For example, one means of rigidly attaching the open web girders 8 to one another is shown in FIGS. 6 and 8. Thus, a metal plate 42 is attached to each of the ends of each of the open web girders 8 of the ceiling panel 41. The plates 42 can be attached, for example, by welding each plate between the flange 17 and 18 of the open web girders 8. The metal plate at each of the ends of the open web girders 8 of the ceiling panel 41 extends over the top of the corresponding open web girder 8 embedded in the side-wall panel 40 on that side of the building module, and abuts the top of another metal plate 43 attached to the upper end of the corresponding open web girder 8. The abutting metal plates 42 and 43 can be attached to one another, for example by welding, thus rigidly attaching the ceiling panel 41 to the two side-wall panels 40.

Similarly, one preferred means for rigidly attaching the floor panel 30 to the two side-wall panels 40 is to rigidly attach the lower ends of the open web girders 8 of the side-wall panels 40 to the rib members 31 disposed along the corresponding sides of the floor panel 30. For example, additional metal plates 44 can be attached to the lower ends of each of the open web girders 8 of the two side-wall panels 40 by welding the plates 44 between the respective flanges 17 and 18 of the girders 8 as shown particularly in FIGS. 6 and 9. The additional metal plates 44 are shown attached, for example by welding, to anchor plates 45 embedded in the outer surface of the rib member 31 adjacent the lower ends of the respective open web girders 8. One means for embedding the anchor plates 45 in the rib member 51 is to attach, for example be welding, the anchor plate 45 to the reinforcing rods 34 which extend at least partially across the floor panel 30, as shown specifically in FIG. 9. These reinforced rods 34 are preferably attached to additional reinforcing rods 46 which extend longitudinally along the length of the rib member 31, thus providing a framework of reinforcing rods about which the floor panel 30, as well as the rib members 31 which are preferably integrally cast therewith, can be formed from a concrete-like material.

By way of illustration, another type of floor which can be used for the building module is shown in FIG. 10. The two side-walls 6 and the ceiling 14 can be of the same construction as the walls and ceiling described with respect to FIGS. 3–9. The floor 50 is of a similar construction and includes a thin, continuous layer or panel 31 of a concrete-like material having spaced-apart open web girders such as open web bar girders 8 embedded in the lower surface of the panel. The ceiling panel 41 can be rigidly attached to the two side-wall panels 40 as described above, and the floor panel 51 can be rigidly attached to the two side-wall panels 40 in a similar manner. For example, a metal plate 52 can be attached to each of the ends of the open web girders 8 of the floor panel 51, for example by welding the plates between the two flanges 17 and 18 of each of the girders. The plates 52 can subsequently be attached to the corresponding plates 44 attached to the lower end of the open web girders 8 embedded in each of the two side-wall panels 40, thus rigidly attaching the floor panel 51 to the two side-wall panels 40.

The building module 1 thus comprises a rigid, box-like structure having an opening at each of the two opposite sides thereof. The building module is sufficiently rigid to enable the module to be lifted or hoisted onto a truck to be transported to a construction site and subsequently placed into position in the building to be constructed. However, additional rigidity can be provideed by securely positioning the open web girders 8 with respect to one another. Accordingly, referring to FIG. 5 and 8, one means for rigidly positioning the girders is shown wherein a hole or opening 53 is provided in the metal plates 42 attached to both ends of each of the open web girders 8 embedded in the ceiling panel 41. A rod or other elongated member 54 is passed through the openings 53 on each side of the module and subsequently attached to the plates 42 on that side, for example, by welding the rod to the plates. The rods 54, which preferably extend the full length of the side-wall panels 40, not only rigidly positions the open web girders 8 of the ceiling and side-wall panels with respect to one another, but also provide several other advantages which will be more fully explained hereinafter. Briefly, these rods, and the open web girders of the ceiling panel, provide a rigid frame which can be used to lift or hoist each of the building modules into position at the construction site and they also serve as reinforcing for a portion of the concrete supporting columns or walls of the building to be constructed from the building modules.

One advantage of having the open web girders 8 of the two side-wall panels 40 rigidly positioned with respect to one another is that an opening, for example for a door, can be made in at least one of the two side-wall panels 40 of the building module to provide access to another building module adjacent thereto which has a corresponding opening in one of its side-wall panels. Thus, referring to FIG. 11, one preferred type of opening which can be formed in one side-wall of a building module is shown. The opening 56 extends in the vertical direction from the floor panel 30 up to the ceiling panel 41 and can be formed by constructing the side-wall 6 of the building module 1 from two thin, continuous layers or panels 57 and 58 of a concrete-like material. The two panels 57 and 58 are spaced-apart from one another to define the opening 56 between the panels. Thus, it can be seen that the respective size of the two panels can be selected so that the opening in the side-wall can be positioned at any point along the side-wall. The size of the opening can also be selected in accordance with the design of the respective building modules. In particular, although the preferred opening 56 extends up to the ceiling panel 41, the height of the opening can be less, for example, by forming an opening in one thin, continuous layer or panel of a concrete-like material rather than using two spaced-apart panels 57 and 58 to form the opening. One advantage in using the two spaced-apart panels is that each panel has the structural integrity which would not necessarily be provided by one panel having an opening formed therein. Further, once the two spaced-apart panels 57 and 58 have been rigidly attached between the ceiling panel 41 and the floor panel 30, the rod 54 which rigidly positions the open web girders 8 of the side-wall 6 having the opening 56 therein with respect to one another provides additional rigidity across the top of the opening.

The prefabricated building module as described above comprising at least two side-walls, a ceiling and a floor has a significantly reduced weight to habitable volume ratio that the habitable volume within the building module can preferably be completely endosed at the place where the module is prefabricated while still keeping to the total weight of the module below the maximum lifting capacity of conventional hoisting equipment such as climbing cranes. Thus, referring to FIGS. 12 and 13, the building module 1 is shown having an additional wall covering each of the openings in the two opposing ends of the module. Since the building module is generally sufficiently rigid without these additional walls being in place, the additional walls preferably are as lightweight as possible. Further, since the additional walls are generally exposed once the building has been constructed, the walls should be attractive to enhance the overall appearance of the building.

Figure 12:
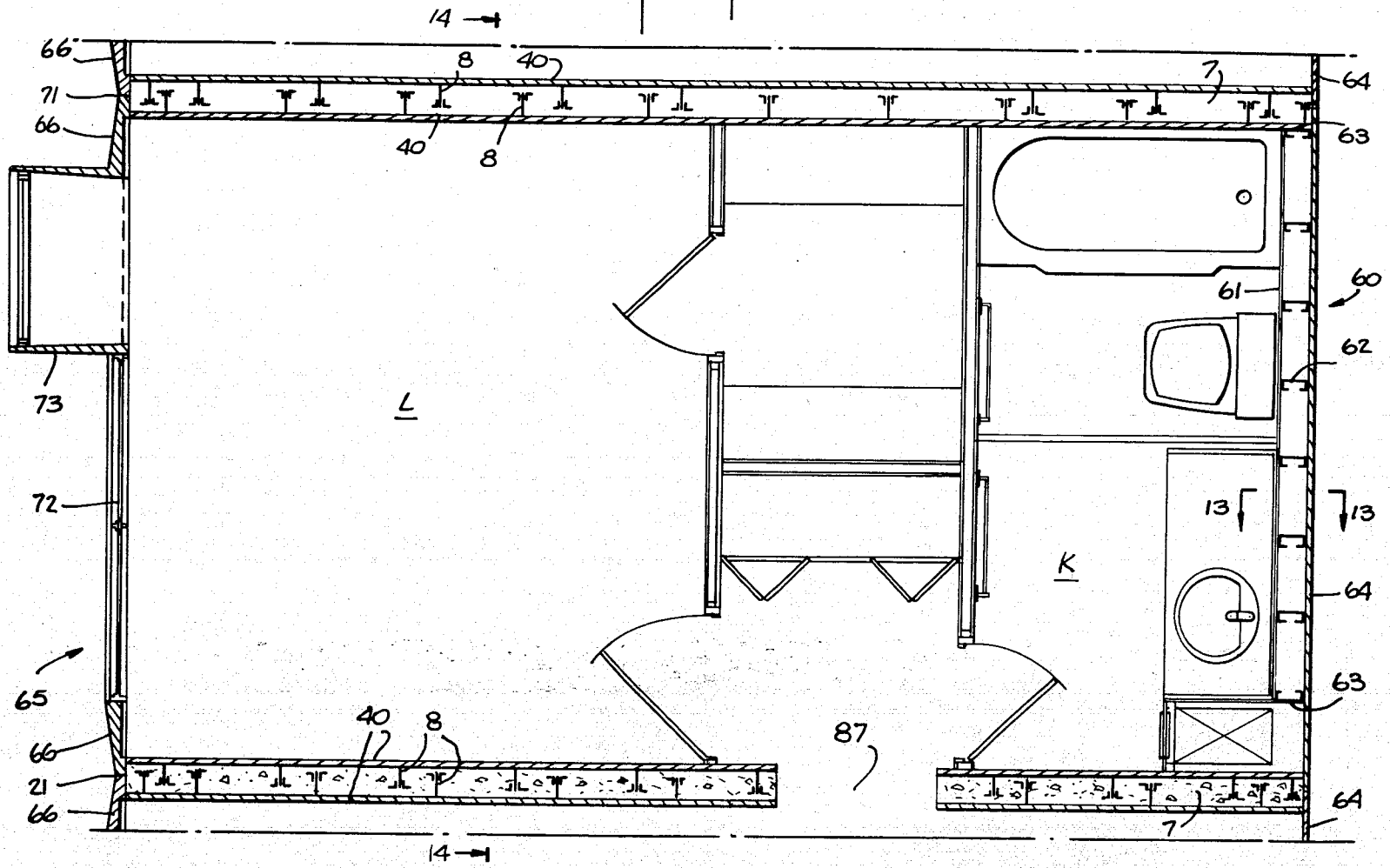
FIG. 12 is a plan view of the building module.

By way of example, one of the additional walls 60 can be constructed in a conventional manner wherein a layer 61 of a standard building material such as plaster board or wood paneling is mounted to a plurality of vertical studs 62 spaced-apart from one another. The one additional wall 60 is preferably inset into the opening in the one end of the building module 1 so that the ends or edges 63 of this wall abut the side-wall, ceiling and floor panels of the module. Thus, once the building modules has been placed in position in the building, the exterior surface of the one additional wall 60 can be finished by also attaching another layer 64 of a standard building material to the studs or, for example, a layer of a concrete-like material can be sprayed onto a wire mesh attached to the studs. As shown in FIG. 12, the other additional layer 64 preferably abuts each of the additional layers 64 of the adjacent building modules, thus covering the open ends of the spaces 7 between the adjacent modules. If the one additional wall 60 is to be exposed to sun-light, an opening for the window can also be provided in the wall.

To enhance the appearance of the facade of the building to be constructed from the building modules, the other additional wall can be given special architectural treatment, keeping in mind that windows should preferably be provided in the wall. For example, the other additional wall 65 shown in FIGS. 1 and 12 includes a frame 66, preferably constructed from a concrete-like material, which extends around the perimeter of the opening in the other end of the building module 1. The frame 66 is preferably rigidly attached to the other open end of the building module 1 before the module is placed into position in the building; however, the frame can also be attached once the module is in place.

The outside dimensions of the frame 66 are preferably selected so that the outer edge 71 of the frame will abut, or be closely adjacent to, the outer edge of the frame of other building modules to be placed above, below and on either side of the building module. In FIG. 12, the outer edge 71 of frame 66 of the building module 1 is shown abutting the outer edge 71 of the frame 66 of the other building module on each side of the module. As will be explained more fully hereinafter, abutting the outer edges 71 of the frames of adjacent building modules closes the other end of the space between the adjacent modules so that a concrete-like material can be poured into the space. The interior 72 of the frame 66 is preferably fitted with windows which can be secured therein in one of several ways known to the art. Further, an alcove 73 such as a window seat can also be provided in the interior 72 of the frame. As shown in FIG. 12, the respective walls defining the alcove 73 can be formed from a concrete-like material integrally cast into the concrete-like material of the frame 66.

As described above, a ledge extending from the one end of the building module can be provided to form a portion of a hallway or other means for access to the building modules of the building. Thus, referring to FIG. 13, one type of ledge 9 that can be provided is shown extending from the upper portion of the one additional wall 60 of the building module 1. The ledge 9 preferably extends along the top of the one additional wall 60 so that one end thereof will abut the respective end of the ledge on the other building module adjacent each side of the building module. The ledge 9 can be constructed by providing a plurality of spaced-apart joists 75 extending outwardly from the building module 1. The ledge 9 can have a layer 76 of a concrete-like like material attached to the lower flanges of the joists 75, for example, by casting the flanges into the concrete-like material. Additional rigidity for the ledge 9 can be provided by connecting a member 77 which extends along each of the sides of the ledge to the respective ends of the joists 75. The ledge 9 can be held in a horizontal position while the building module is being transported or otherwise handled by spaced-apart straps 78 which are connected at one end to the ledge and at the other end to one of the open web girders 8 embedded in the ceiling panel 41. When the building module 1 is placed in position in one of the rows 4 or 5 of the building, as shown in FIGS. 1 and 2, the side 79 of the ledge 9 of the building module preferably abuts the side of the ledge of the building module in the other row 4 or 5 which opposes the building module. Accordingly, the abutting ledges 9 of two opposing building modules 1 on the second floor or layer 3 of the building modules would form a deck or floor between the two modules to be placed directly above on the third floor (not shown) and also form a ceiling above the abutting ledges 9 of the two opposing building modules 1 in the first floor 2 directly below the modules, thereby providing a covered passageway or hallway between the opposing modules on the second floor 2.

Figure 18:
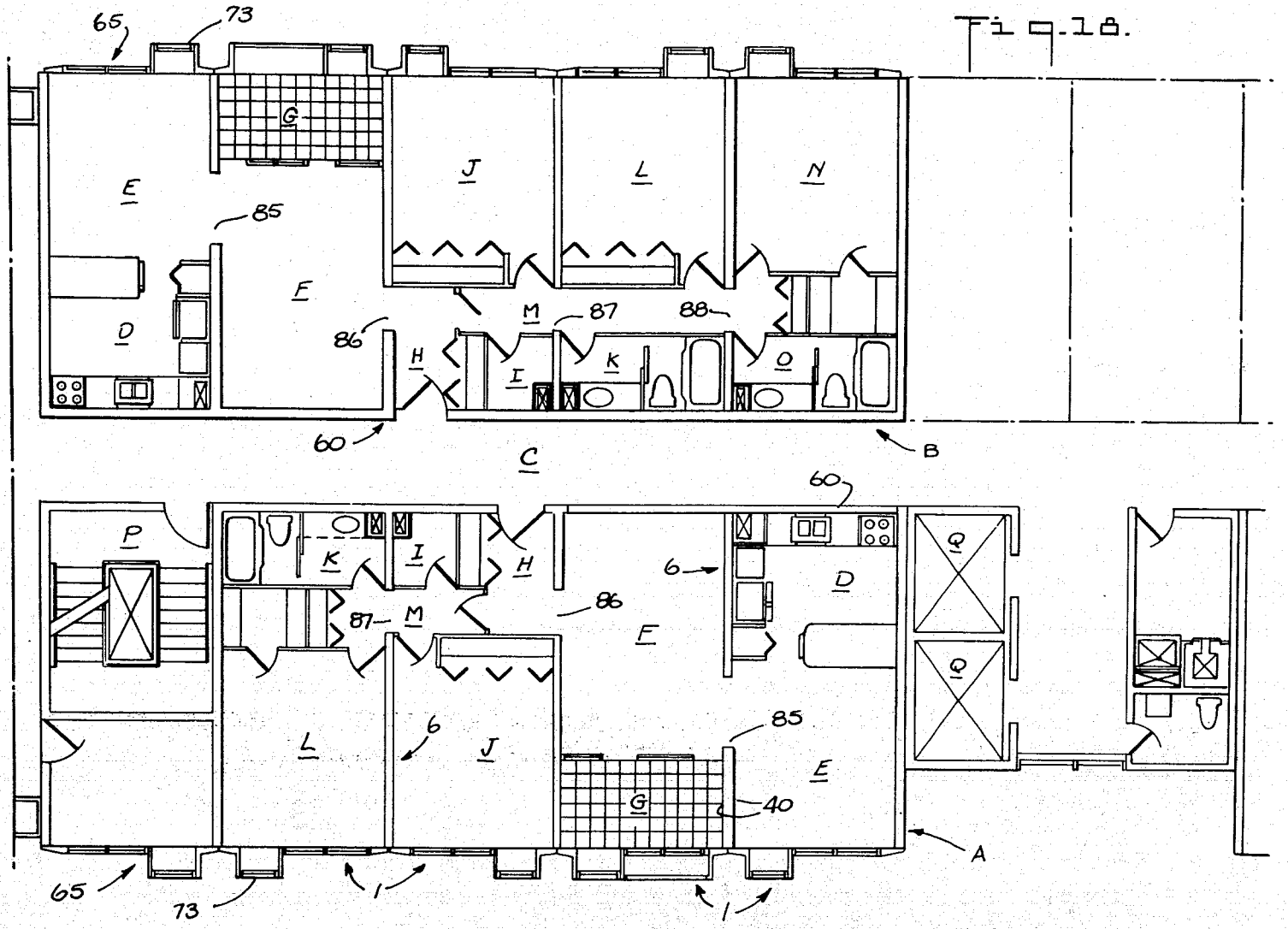
FIG. 18 is a partial plan view of one floor of a building constructed from the building modules.
Figure 18:
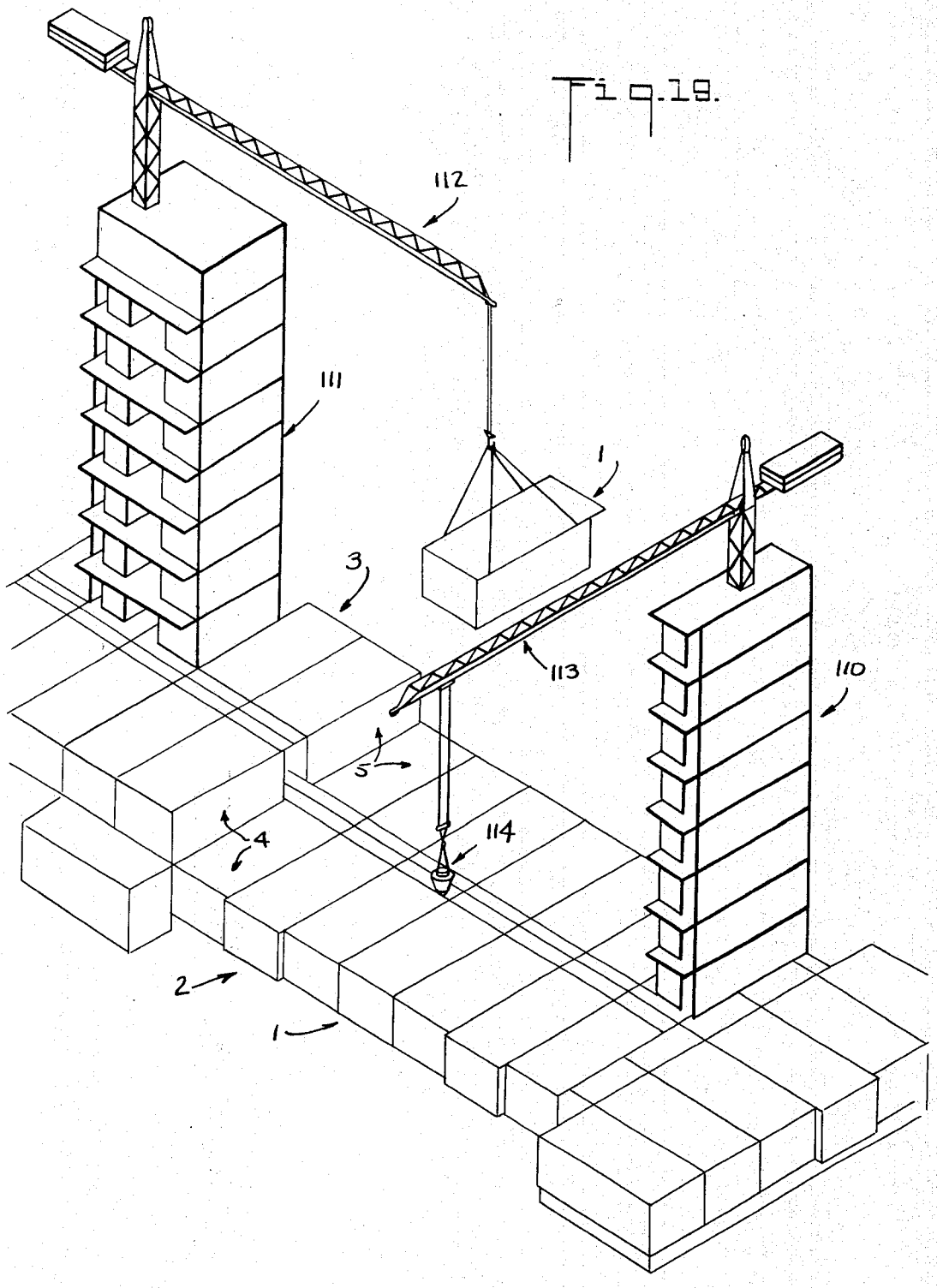

Before the prefabricated building module is completed at the factory and ready to be transported to the construction site, the habitable volume enclosed therein can be completely finished to include, for example, the necessary partitioning, plumbing and electrical wiring. Accordingly, referring briefly to FIG. 18, a portion of a floor plan for one of the floors of a building which can be constructed from the building modules of the present invention is shown. The floor plan provides for a two bedroom apartment, generally designated A, and a three bedroom apartment generally designated B, and disposed on opposite sides of a hallway or other passage, generally designated C, which provides access to the two apartments. The two bedroom apartment A is constructed from four separate building modules 1 placed side by side. One of the building modules includes a kitchen area D having provision for standard kitchen appliances such as a range, refrigerator and dishwasher and a dining area E. The next adjacent building module provides the living area F of the two bedroom apartment A which includes an enclosed terrace G adjacent the exterior wall of the building. A corresponding opening is provided in each of the side-walls 6 between the adjacent building modules, as described above, thus forming an opening 85 between the living room F and the dining room E. The next adjacent building module encloses the entry foyer H, a utility closet I and one of the bedrooms J, while the last building module encloses a bathroom K and the second bedroom L. A hallway M providing access from the living room F to the second bedroom L and bathroom K is formed in part by providing openings 86 and 87 between the three latter modules. As shown in FIG. 18, the three bedroom apartment B is almost identical with the two bedroom apartment A with the major exception being the addition of a fifth building module enclosing the third bedroom N and the second bathroom O, and an opening 88 into the fifth module. Still referring to FIG. 18, at selected places within the building to be constructed from the building modules, provision can be made for at least one stairwell P extending from the lower or ground floor of the building to the upper floor thereof and, if desired, one or more elevator shafts Q.

Once the building modules of the present invention have been prefabricated and transported to the construction site, the modules can be placed into position to form a building, for example, such as the one shown in FIGS. 1 and 2. Thus, the building modules comprising the first floor 2 of the building are assembled with at least one side-wall 6 of each building module being adjacent to, and approximately opposite from, one of the side-wall 6 of a different building module 1 with the adjacent building modules being spaced-apart to define a space 7 between the side-wall panels 40 of the adjacent side-walls 6. The open web girders 8 embedded in the one surface of the adjacent side-wall panels 40 extend into space 7 between the adjacent modules. As noted above, the width of the space between the adjacent modules is preferably selected in accordance with the structural requirements of the building to be constructed so that the weight supporting columns or walls to be formed between the adjacent modules will be capable of withstanding the loads imposed thereon. As shown in FIGS. 12 and 15, it is preferable that the open web girders 8 embedded in one of the adjacent side-wall panels 40 have a different spacing from one end of the building module than the open web girders 8 embedded in the other adjacent side-wall panel 40 so that the open web girders extending into the space between the adjacent side-wall panels can be nested with one another when the spacing between the modules is less than twice the depth of the girders.

As noted above, the prefabricated building module of the present invention can be constructed so that the total weight of the module is less than the lifting capacity of conventional hoisting equipment as a climbing crane. Thus, as shown in FIG. 1, the building modules 1 can be placed into position in the building by the climbing crane 89. Since the rods 54 which extend along the top of each of the two side-walls 6 and the open web girders 8 embedded in the ceiling panel 41 to which they are attached form a rigid frame on top of the module. The sling 90 for lifting the building module 1 can be directly coupled or hooked to the rods 54.

Once the adjacent building modules 1 have been so assembled, at least a portion of the space 7 between the adjacent side-wall panels 40 can be filled with a concrete-like material for forming a weight supporting column or wall between at least a portion of the adjacent building modules. The amount of the concrete-like material to be poured into the space between the adjacent building modules will be determined by structural analysis of the building. Thus, if more concrete is needed, the space 7 between the modules 1 can be increased, and similarly, if less concrete is needed the width of the space 7 can be decreased. However, the minimum width of the space 7 is limited by the depth of the open web girders 8 extending into the space. Therefore, if less concrete is needed to form a supporting column or wall, only a predetermined portion of the space between the adjacent modules need be filled with the concrete-like material. By way of example, FIG. 17 shows a cross-section of two contiguous floors 91 and 92 of building modules 1 wherein the space between the adjacent modules on the lower floor 91 is completely filled with a concrete-like material forming a wall 93 between the adjacent modules. The space between the adjacent modules 1 on the other floor 92 is only partially filled thereby forming three columns 94 between the modules.

Now, referring to FIG. 14, a cross-sectional view of the adjacent building modules of FIG. 13 is shown. For purposes of illustration only, the cross-sectional view includes a portion of three floors or layers of building module being assembled in accordance with the present invention. Thus, the building modules 1 comprising the lowest floor 95 of building modules are shown spaced-apart from one another with the space 7 between the adjacent side-wall panels 40 filled with a concrete-like material, thus forming a supporting column or wall 96 between the adjacent modules. The open web girders 8 embedded in each of the adjacent side-wall panels 40 serve to reinforce the concrete-like material forming the column or wall 96 and also to integrally connect the building modules 1 on each side of the column or wall to the column. The column 96 can be further reinforced by providing; for example, additional reinforcing rods 97 in the space 7 before the concrete-like material is poured.

Before the building modules comprising the middle floor of building modules are placed into position, a cap or shoulder 99 is formed on top of the supporting column or wall 96 formed between the adjacent building modules comprising the lowest floor 95. The cap or shoulder 99 extends along at least a portion of the length of the supporting column or wall 96 with a portion 100 of the cap or shoulder 99 extending over each of the adjacent side-wall panels 40 on either side of the supporting column 96. The cap or shoulder 99 can be formed after the concrete-like material has been poured into the space 7 between the adjacent side-walls 40 or it can be formed integrally therewith. The portions 100 of the cap or shoulder 99 on top of the supporting column or wall 96 are reinforced at various points along the length of the cap by the open web girders 8 embedded in the ceiling panels 41 of the adjacent modules on the lowest floor 95 on either side of the column. The portions 100 can also be reinforced along their length by the rods 54 which can be attached, as described above, to the respective ends of the open web girders length by the rods 54 which are attached to the respective ends of the open web girders 8 of the modules.

Once a cap or shoulder 99 has been formed over the supporting column or wall 96 on either side of the building module 1 on the lowest floor 95, another building module 105 forming a portion of the middle floor or layer 98 of building modules can be placed directly above the building module 1 with the floor panel 30 of the other building module 105 being supported by the cap or shoulder 99 on each side of the building module. Thus, as shown in FIG. 14, at least a portion of the flat bearing or load supporting surface 32 of the one rib member 31 disposed around the perimeter of the floor panel 30 rests upon the portions 100 of the caps or shoulders 99 extending over the two side-wall panels 40 of the building module 1 directly below.

Once two adjacent building modules 105 forming a portion of the middle floor 98 of building modules have been assembled in accordance with the present invention, at least a portion of the space 7 between the adjacent side-wall panels 40 of the two building modules 105 is filled with a concrete-like material, thus forming a supporting column or wall 106 between the adjacent modules 105. The column 106 is disposed on top of the cap or shoulder 99 and is supported by the supporting column or wall 96 formed between the adjacent modules 1 directly below. If still another floor or layer of building modules is to be provided, as shown in FIG. 14, a cap or shoulder 107 is again formed, as previously described, on the top of the supporting column or wall 106 formed between the adjacent modules 105 on the middle floor 98 of building modules.

From the foregoing, it should be clear that the lightweight, rigid prefabricated building module of the present invention provides several advantages not present in known building modules. One particular advantage is that a plurality of the building module, due to their light-weight construction, can be assembled into a building by means of conventional hoisting equipment such as a climbing crane which would otherwise be incapable of lifting conventional concrete modules. Thus, a building can be constructed from the building modules of the invention without the expense of conventional ground-mounted heavy-duty hoisting equipment. In addition the uppermost floors of such a building can extend well above the maximum boom length of conventional ground-mounted heavy-duty hoisting equipment. One preferable way to asssemble the building modules into rows and columns for forming the building is to use a climbing crane that is mounted upon a vertical tower or column which is designed to ultimately become a part of the building.

Accordingly, referring to FIG. 19, a portion of a multistory building being constructed from the prefabricated building modules 1 is shown. The portion of the building is similar to the one illustrated in FIG. 1 in that it has a plurality of floors or layers 2 and 3 of building modules wherein each floor includes two spaced-apart rows 4 and 5 of building modules. In addition, two vertical towers or columns 110 and 111 are constructed at preselected positions within the building. For example, one vertical tower 110 can be provided to enclose a stairwell, such as the stairwell P illustrated in FIG. 18, while the other vertical tower 111 can be provided to house one or more elevator shafts, such as the elevator shafts Q also illustrated in FIG. 18

The two towers 110 and 111 are preferably constructed from cast-in-place concrete; they can be constructed by other construction techniques. Each vertical tower is initially constructed to enable a climbing crane to be mounted to the towers adjacent the top portion thereof to be used to assemble the building modules 1 as described above. As illustrated in FIG. 19, one of the climbing cranes 110 is placing a building module 1 adjacent another building module while the other climbing crane 113 is lifting a bucket 114 containing a concrete-like material to be poured between adjacent building modules It will be apparent that the spacing between the vertical towers is preferably less than twice the boom length of the climbing cranes so that the entire area of the building between the towers can be serviced by one or the other of the cranes.

As the level of the building modules being assembled rises, the height of one or more of the vertical towers can be increased. The climbing crane mounted thereto can subsequently be hoisted or lifted to adjacent the top portion of the tower where it can be remounted to the tower. Thus, the climbing crane can be used again to assemble further rows of building modules for forming additional stories of the building. Accordingly, it can be seen that a building constructed from the building modules of the present invention can have a significant number of stories, which number is not limited by the boom length of heavy-duty hoisting equipment.

Other modifications and variations of the building module, the method of construcing a building from the building modules and the building so constructed will be apparent to those skilled in the art, and they may be made without departing from the spirit and scope of the present invention which is claimed herein.

What is claimed is:

1. A prefabricated lightweight building module in the form of a rigid box having at least one room within the interior thereof, the module being adapted to be handled and transported without appreciable deflection or distortion from the box form and comprising at least two opposing side-wall portions, a ceiling portion and a floor portion, each of the two side-wall portions and ceiling portion including a thin layer of concrete-like material and a plurality of open-web elongated tensile reinforcing members spaced-apart at a pre-determined interval and parallel with respect to one another, each reinforcing member extending across the outer surface, of the thin layer with a portion of the length of each reinforcing member being attached to the outer surface, the other portion of the length of each reinforcing member extending outwardly from the outer surface, the reinforcing member of the side-wall portions extending vertically as columns, the reinforcing members of the ceiling panel extending horizontally as beams, and means for rigidly attaching the upper end portions of the reinforcing member of each of the side-wall portions to the end portions of the reinforcing members of the ceiling portion adjacent thereto and the lower end portions of the reinforcing members of each of the side-wall panels to the edges of the floor portion adjacent thereto to form a rigid box-like structure, the building module being adapted to be placed with one of the side-wall portions thereof substantially parallel and adjacent to one side-wall portion of another building module of a type corresponding thereto in a facing arrangement spaced apart therefrom to construct a building therewith, the outer surface of each of the thin layers of the spaced-apart side-wall portions of adjacent building modules providing a form structure defining a cavity thereinbetween into which a wall of concrete-like material extending for the height of the side-wall portions can be poured, the other portions of the length of at least some of the reinforcing members of the side-wall portion of the module and of the other module being adapted to extend into the cavity of the form structure to reinforce the wall to be poured and to integrate the side-wall portions of the module and the other module with the wall for supporting the module and the other module with respect thereto, the thin layer of the side wall portions of the module having a thickness substantially limited to that required to withstand the stresses of moving the module into place in a building and the pressure of the poured wall of concrete-like material before it sets, the distance extending from the front of a side-wall portion and the ceiling portion to the reinforcing member nearest thereto being different from the distance extending from the rear of the side-wall portion and the ceiling portion to the reinforcing member nearest thereto to enable the outwardly extending portions of the reinforcing members of one side-wall portion of the module to nest between the outwardly extending portions of the reinforcing members of a side-wall portion of another module in which the location of the reinforcing members thereof are complementary to the reinforcing members of the building module.

2. A prefabricated building module in accordance with claim 1 in which at least one of the thin layers of the two side-wall portions has an opening therein, the opening extending at least from adjacent the other surface of the thin layer of the floor portion towards the ceiling portion, the opening to form a portion of a passage between the building module and an additional building module having a corresponding opening therein, the additional building module to be placed adjacent the side-wall of the building module having the opening therein when a building is to be constructed from the modules.

3. A prefabricated building module in accordance with claim 2 in which the opening extends from at least the thin layer of the floor portion to the thin layer of the ceiling portion.

4. A prefabricated building module comprising a pair of spaced-apart oppositely disposed side-wall panels each of which extends in a vertical plane when disposed in its operative position in a building, a floor panel, and a ceiling panel, the side-wall panels being rigidly connected to the floor and ceiling panels to form a prefabricated building module corresponding to a room unit, each side-wall panel and the ceiling panel being a lightweight rectangular metal-reinforced concrete wall panel including:

a. a thin rectangular membrane of lightweight concrete material having a first substantially flat surface and a second surface substantially parallel to the first surface, the two surfaces being bounded by a front edge, a edge and two side edges, the concrete membrane of the side-wall panels being no thicker than necessary to withstand the hydrostatic pressure equivalent to that exerted by a wall of concrete poured against the second surface for the height of the panel when the front and rear edges are vertical;

b. first elongated metallic reinforcing elements wholly embedded in the membrane and extending between the front edge and the rear edge of the membrane in a plane intermediate the first and second surfaces, the elements being the only components of the panel serving as tensile reinforcement to withstand tensile loads acting in the plane of the panel perpendicular to the front and rear edges; and c. a plurality of metallic reinforcing members extending substantially parallel to, and at predetermined intervals between the front and rear edges of the membrane, each reinforcing member having i. a first straight edge portion embedded in the membrane between the first reinforcing elements and the second surface and extending from one side edge to the other side edge of the membrane, ii. a second straight flange-like edge portion spaced outwardly from the second surface of the membrane at a predetermined distance substantially greater than the thickness of the membrane and extending parallel to the line of the first edge portion for at least the length of the first edge portion, and iii. an open web intermediate portion for rigidly connecting the first edge portion to the second edge portion, the web portion and the second edge portions of adjacent reinforcing members forming open uninterrupted recesses, in conjunction with the second surface of the membrane, from the first side edge to the second side edge, the distance between the front edge of each wall panel and the reinforcing member nearest thereto being different from the distance between the rear edge of the wall panel and the reinforcing member nearest thereto to permit the outwardly extending portions of the reinforcing members of one side-wall panel of a first building module to nest between the outwardly extending portions of the reinforcing members of an identical side-wall panel of a second building module in which the identical panel of the second building module is turned end for end with respect to said side-wall panel of the first building module.

5. The prefabricated building module of claim 4 further comprising:

a metallic connecting member attached to the first and second edge portions at one end of each metallic reinforcing member of each of the side-wall and ceiling panels and extending in the line of the reinforcing member beyond the adjacent side edge of the membrane for a distance approximately equal to the spacing between the first and second edge portions of the reinforcing member for making a right angle rigid joint connection with a reinforcing member of another panel when assembling a room module.

6. The prefabricated building module of claim 5 wherein each metallic connecting member comprises a rectangular plate welded to each edge portion of the corresponding reinforcing member, the second edge portion of the reinforcing member extending along one side of the plate beyond the adjacent side edge of the membrane and being fastened to the side of the plate to reinforce the plate against buckling when the connecting member is subjected to bending moments in the plane thereof.

7. A prefabricated building module in the form of a box comprising at least two opposing side-wall portions, a ceiling portion and a floor portion, each of the two side-wall portions and the ceiling portion including a thin layer of concrete-like material and a plurality of open-web elongated tensile reinforcing members spaced-apart from one another and extending approximately vertically across one surface of the thin layer of each side-wall portion in the manner of studs and extending approximately horizontally across one surface of the ceiling portion in the manner of beams with one portion of each reinforcing member being embedded in the one surface and the other portion of each reinforcing member being exposed and extending outwardly therefrom, and means for rigidly attaching at least two of the reinforcing members of each of the side-wall portions to corresponding reinforcing members of the ceiling portions and to the floor portion for forming a rigid, box-like structure, the building module being adapted to be placed with one of the side-wall portions thereof adjacent to the spaced-apart from one side-wall portion of another building module to construct a building therefrom, the thin layers of the adjacent side-wall portions providing a form structure into which a wall of concrete-like material can be poured between the spaced-apart side-wall portions of the adjacent building modules, the other portion of at least some of the reinforcing members of the adjacent one side-wall portions extending in spaced-apart nesting relation into the form structure and being adapted to reinforce the wall to be poured and to integrate the building module with the wall, the thin layers of the side-wall portions being no thicker than necessary to withstand the stresses of moving the module into place in a building and the pressure of the poured wall of concrete-wall material before it sets, each reinforcing member including two parallel flanges and an open web extending between the two flanges substantially throughout the length thereof, one of the flanges of each reinforcing member being embedded in the one surface of the thin layer of the respective portions and extending substantially parallel to the plan thereof, the other flange and at least a portion of the open web being exposed and extending outwardly therefrom, the reinforcing members of the ceiling portion which are rigidly attached having ends oppositely disposed along the length thereof which are substantially in alignment with the upper end of corresponding reinforcing members of each of the two side-wall portions, and in which the means for rigidly attaching reinforcing members of each of the side-wall portions to the corresponding reinforcing members of the ceiling portion include means for rigidly securing the upper end of the reinforcing members of each of the two side-wall portions to the end of the reinforcing members of the ceiling portion adjacent thereto.

8. A prefabricated building module in the form of a box comprising at least two opposing side-wall portions, a ceiling portion and a floor portion, each of the two side-wall portions and the ceiling portion including a thin layer of concrete-like material and a plurality of elongated metallic reinforcing members extending approximately vertically across one surface of the thin layer of each side-wall portion in the manner of studs and extending approximately horizontally across the one surface of the ceiling portion in the manner of joists, with one portion of each reinforcing member being embedded in the one surface and the other portion of each reinforcing member extending outwardly therefrom, and a means rigidly attaching at least two of the reinforcing members of each of the side-wall portions to corresponding reinforcing members of the ceiling portion and to the floor portion for forming a rigid, box-like structure, the building module being adapted to be placed with one of the side-wall portions thereof adjacent to and spaced-apart from one side-wall portion of another building module to construct a building therefrom, the thin layers of the adjacent side-wall portions providing a form structure into which a wall of concrete-like material can be poured between the spaced-apart side-wall portions of the adjacent building modules, the other portion of at least some of the reinforcing members of the adjacent one side-wall portions extending in spaced-apart nesting relation into the form structure and being adapted to reinforce the wall to be poured and to integrate the building module with the wall, the thin layers of the side-wall portions being no thicker than necessary to withstand the stresses of moving the module into place in a building and the pressure of the poured wall of concrete-like material before it sets, and each reinforcing member including two parallel flanges and an open web extending between the two flanges substantially throughout the length thereof, one of the flanges of each reinforcing member being embedded in the one surface of the thin layer of the respective portions and extending substantially parallel to the plane thereof, the other flange and at least a portion of the open web being exposed and extending outwardly therefrom, the two side-wall portions and the ceiling portion each having the same number of spaced-apart open web members, a plate being rigidly attached to each end of each of the open web members of the ceiling portion and to the upper end of each of the open web members of the two side-wall portions, each of the plates being attached between the spaced-apart flanges of the open web members, and in which the means for rigidly attaching at least two of the reinforcing members of each of the side-wall portions to the ceiling portion include means for rigidly attaching the plate at the upper end of each of the open web members of each of the two-side portions to a corresponding one of the plates at the ends of the open web girders of the ceiling portion adjacent the respective side-wall portion.

9. A prefabricated building module in accordance with claim 8 in which a stiffening member extends along at least a portion of the upper end of each of the two side-wall portions and approximately parallel thereto, each stiffening member being attached to one of the ends of at least two of the reinforcing members adjacent the side-wall portion along which the stiffening member extends.

10. A prefabricated building module in accordance with claim 8 in which the plate at each of the ends of the reinforcing members of the ceiling portion has an opening therein, each stiffening member being a rod which extends substantially along the upper end of each of the two side-wall portions, one of the rods extending through the openings in the plates at a different one of each of the ends of the reinforcing members and being attached to at least two of the plates.

11. A prefabricated building module in the form of a box comprising at least two opposing side-wall portions, a ceiling portion and a floor portion, each of the two side-wall portions and the ceiling portion including a thin layer of concrete-like material and a plurality of open web elongated metallic reinforcing members spaced-apart from one another, each reinforcing member extending approximately vertically across one surface of the thin layer of each side-wall portion in the manner of studs and extending approximately horizontally across the one surface of the ceiling portion in the manner of joists, with one portion of each reinforcing member being embedded in the one surface and the other portion of each reinforcing member extending outwardly therefrom, the floor portion including a thin layer of concrete-like material and rib members integral with the thin layer and extending from the outer surface thereof both around at least a portion of the perimeter of the thin layer and substantially across the thin layer in spaced-apart relation to each other and at least two anchor plates embeded in the peripheral rib members on each side of the floor portion adjacent the side-wall portions, a means for rigidly attaching at least two of the reinforcing members of each of the side-wall portions to corresponding reinforcing members of ceiling portion, and a means for rigidly attaching the lower end of each of said at least two reinforcing members of each side-wall portion to a corresponding one of the anchor plates embedded in the peripheral rib members of the floor portion for forming a rigid, box-like structure, the building module being adapted to be placed with one of the side-wall portions thereof adjacent to and spaced-apart from one side-wall portion of another building module to construct a building therefrom, the thin layers of the adjacent side-wall portions providing a form structure into which a wall of concrete-like material can be poured between the spaced-apart side-wall portions of the adjacent building modules, the other portion of at least some of the reinforcing members of the adjacent one side-wall portions extending in spaced-apart nesting relation into the form structure and being adapted to reinforce the wall to be poured and to integrate the building module with the wall, the thin layers of the side-wall portions being no thicker than necessary to withstand the stresses of moving the module into place in a building and the pressure of the poured wall of concrete-like material before it sets.

* * * * *

UNITED STATES PATENT AND TRADEMARK OFFICE

CERTIFICATE OF CORRECTION

PATENT NO. : 3,990,193

DATED : November 9, 1976

INVENTOR(S) : Orlando F. Ray and Enrique H. Gutierrez

It is certified that error appears in the above-identified patent and that said Letters Patent are hereby corrected as shown below:

Column 1, line 27, "imparied" should be --impaired--.

Column 1, line 30, "permimt" should be --permit--.

Column 2, line 9, "invenion" should be --invention--.

Column 2, line 27, "colume" should be --column--.

Column 2, line 66, "alternaate" should be --alternate--.

Column 3, line 25, "havivng" should be --having--.

Column 3, line 29, "materil" should be --material--.

Column 4, line 39, delete "1θ" and insert --one and one quarter--.

Column 4, line 57, "one space" should be --one surface--.

Column 7, line 45, "rigdly" should be --rigidly--.

Column 8, line 29, "side-walll" should be --side-wall--.

Column 8, line 31, "if" should be --of--.

Column 9, line 47, "provideed" should be --provided--.

Column 9, line 49, "FIG." should be --FIGS.--.

Column 10, line 42, "endosed" should be --enclosed--.

Column 10, line 64, "this" should be --the--.

UNITED STATES PATENT AND TRADEMARK OFFICE

CERTIFICATE OF CORRECTION

PATENT NO. : 3,990,193

DATED : November 9, 1976

INVENTOR(S) : Orlando F. Ray and Enrique H. Gutierrez

It is certified that error appears in the above-identified patent and that said Letters Patent are hereby corrected as shown below:

Column 13, line 25, after "equipment" insert --such--.

Column 15, line 32, after ";" insert --however,--.

Column 15, line 42, after "modules" insert --.--.

Column 16, line 18, "member" should be --members--.

Column 16, line 34, "other portions" should be --other portion--.

Column 17, line 21, delete "a edge" and insert --a rear edge--.

Column 18, line 48, "the" should be --and--.

Signed and Sealed this

First Day of March 1977

[SEAL]

*Attest:*

RUTH C. MASON
*Attesting Officer*

C. MARSHALL DANN
*Commissioner of Patents and Trademarks*